US005497443A

United States Patent [19]

Jie et al.

[11] Patent Number: 5,497,443

[45] Date of Patent: Mar. 5, 1996

[54] END MACHINING APPARATUS AND HOLDING FIXTURES FOR OPTICAL CONNECTORS

[75] Inventors: Xu Jie; Jun Takahashi; Kenji Suzuki, all of Tokyo, Japan

[73] Assignee: The Furukawa Electric Co., Ltd., Tokyo, Japan

[21] Appl. No.: 345,133

[22] Filed: Nov. 28, 1994

[30] Foreign Application Priority Data

Dec. 14, 1993 [JP] Japan ..... 5-313208
Aug. 12, 1994 [JP] Japan ..... 6-190394

[51] Int. Cl.[6] ..... G02B 6/00; B23B 5/22

[52] U.S. Cl. ..... 385/134; 385/78; 385/80; 385/85; 385/136; 385/137; 279/99; 279/105.1; 279/110; 279/112

[58] Field of Search ..... 385/76, 77, 78, 385/80, 84, 85, 87, 134, 136, 137, 139; 279/9.1, 19.6, 19.7, 66, 82, 83, 99, 105.1, 110, 112, 142; 51/298, 293

[56] References Cited

U.S. PATENT DOCUMENTS

| | | | |
|---|---|---|---|
| 4,060,315 | 11/1977 | Heinz | 248/487 X |
| 4,272,926 | 6/1981 | Tamulevich | 51/216 R |
| 4,623,156 | 11/1986 | Moisson et al. | 279/106 |
| 4,664,487 | 5/1987 | Tam | 372/107 X |
| 5,321,917 | 6/1994 | Franklin et al. | 51/217 R |
| 5,325,452 | 6/1994 | Stein et al. | 385/67 |
| 5,345,323 | 9/1994 | Basavanhally et al. | 385/59 |
| 5,412,747 | 5/1995 | Matsuoka et al. | 385/85 |
| 5,437,000 | 7/1995 | Dyott | 385/137 |
| 5,442,724 | 8/1995 | Deuel | 385/134 |

FOREIGN PATENT DOCUMENTS

| | | | |
|---|---|---|---|
| 55-115009 | 9/1980 | Japan | 385/85 X |
| 59-93402 | 5/1984 | Japan | 385/85 X |
| 61-156207 | 7/1986 | Japan | 385/85 X |
| 64-38707 | 2/1989 | Japan | 385/85 X |
| 5-4159 | 1/1993 | Japan | 385/134 X |
| WO93/23800 | 11/1993 | WIPO | 385/134 X |

*Primary Examiner*—Brian Healy
*Attorney, Agent, or Firm*—Frishauf, Holtz, Goodman, Langer & Chick

[57] ABSTRACT

Provided is an optical connector end machining apparatus (1) which comprises a removing section (10) for removing an adhesive agent swollen on the respective end faces of optical connectors, a polishing section (20) located adjacent to the removing section and adapted to grind and polish the end faces of the optical connectors cleared of the adhesive agent, and a switching section (30) including a holding member (31) for holding the optical connectors and adapted collectively to shift the optical connectors held by means of the holding member to the removing section or the polishing section, the holding member releasably holding the optical connectors in a manner such that the end face of each optical connector projects and causing the respective projecting end faces of the optical connectors to move integrally toward and away from the removing section or the polishing section. Also provided is a holding fixture for an optical connector used in the end machining apparatus, the holding fixture comprising first and second cylindrical bodies arranged adjacent to each other and a chuck inserted in the first cylindrical body with both ends thereof projecting, one end side of the chuck being removably screwed to the second cylindrical body and the other end side holding the optical connector, the force of the chuck to hold the optical connector being adjustable.

12 Claims, 14 Drawing Sheets

70

END MACHINING APPARATUS AND HOLDING FIXTURES FOR OPTICAL CONNECTORS

BACKGROUND OF THE INVENTION

1. Field of the Invention

The present invention relates to an end machining apparatus and holding fixtures for optical connectors.

2. Description of the Related Art

In connecting optical fibers to one another, optical connectors are attached individually to the respective ends of the optical fibers, and the respective end faces of the connectors are butted against one another.

The following is a description of a conventional method of attaching an optical connector to the ends of the optical fibers, e.g., on an end of a tapefiber which includes a plurality of optical fibers.

First, the end portion of the tapefiber with its optical fibers exposed is inserted into a hollow in the optical connector, which is formed having a plurality of fiber holes for the optical fibers as well the hollow therein, and the exposed optical fibers are inserted individually into the fiber holes. Then, an adhesive agent is filled into the hollow of the optical connector, and is set by heating. Thereupon, each optical fiber slightly projects from the end face of the optical connector, and the adhesive agent is swollen on the end face of the connector as it is set.

After the adhesive agent swollen on the end face of the optical connector and the optical fibers are ground by means of a grinding material, the optical connector is subjected to end machining such that its end face is ground and polished into a specular surface.

In the conventional optical connector end machining, end grinding of the optical connector is started under grinding conditions (load of pressure, grinding speed, abrasive grain coarseness, etc.) used in shaving off the adhesive agent swollen on the end face. Accordingly, the grinding conditions are so heavy that the end face of the optical connector is liable to be marred. Moreover, the depth of grinding varies considerably, depending on the quantity of the adhesive agent, thus exerting a bad influence upon the accuracy of connection of the optical connectors.

If the end faces of the optical fibers are scratched during this grinding process, in particular, it is very hard to mend the scratches by finish polishing afterward. The scratches on the optical fiber end faces must be eliminated because they may increase the connection loss or reflection of transmitted signal light.

The scratches on the optical connector end faces can be eliminated by lightening the grinding conditions for the removal of the adhesive agent which mainly causes the scratches. If the grinding conditions are softened, however, the grinding time is lengthened, thus entailing an increase of the cost of attaching the optical connector to the optical fiber ends.

In another method of elimination, the position of the end face of the optical connector is detected so that the grinding operation for the removal of the adhesive agent can be stopped when the distance between the grinding material and the end face is zero or when the adhesive agent barely exists between the grinding material and the end face.

According to this method, however, the delivery rate of the grinding material must be controlled precisely, so that the end machining apparatus inevitably entails high cost.

According to conventional machining apparatuses for machining the connector end face, moreover, the adhesive agent swollen on the end face of the optical connector and the optical fibers are ground by means of the grinding material of one machining apparatus, while the end face is polished into a specular surface by using another machining apparatus. Thus, the productivity of the optical connectors is too low for the automation of the end machining.

Furthermore, the optical connector end machining involves a problem that the end machining accuracy is lowered unless the optical connector is held securely.

SUMMARY OF THE INVENTION

The object of the present invention is to provide an optical connector end machining apparatus capable of shortening the machining time for optical connectors, thereby improving the productivity, and of machining the connectors at low cost without scratching the end faces of optical fibers, and holding fixtures capable of securely holding the optical connectors as objects of machining and effecting high-accuracy end machining.

In order to achieve the above object, an optical connector end machining apparatus according to the present invention comprises a removing section for removing an adhesive agent swollen on the respective end faces of optical connectors, a polishing section located adjacent to the removing section and adapted to grind and polish the end faces of the optical connectors cleared of the adhesive agent, and a switching section including a holding member for holding the optical connectors and adapted collectively to shift the optical connectors held by means of the holding member to the removing section or the polishing section, the holding member releasably holding the optical connectors in a manner such that the end face of each optical connector projects and causing the respective projecting end faces of the optical connectors to move integrally toward and away from the removing section or the polishing section.

Preferably, the removing section includes a removing member adapted to rotate around a rotating shaft rotated by means of first rotating means, thereby removing the adhesive agent swollen on the end faces of the optical connectors held by means of the holding member.

Further preferably, the removing member includes a grinding material arranged in the circumferential direction for removing the adhesive agent, the grinding material being narrower than the end face of each optical connector and wider than a deposit area of the adhesive agent.

Preferably, the polishing section includes a polishing member adapted to revolve both on its own axis and around an input shaft through the medium of a gear mechanism, thereby grinding and polishing the end faces of the optical connectors, the input shaft being rotated by means of second rotating means.

Preferably, moreover, the holding member is provided with a plurality of fitting holes in which holding fixtures holding the optical connectors are fitted individually, the fitting holes being arranged at predetermined intervals in the circumferential direction.

In order to achieve the above object, furthermore, a holding fixture according to the present invention comprises first and second cylindrical bodies arranged adjacent to each other and a chuck inserted in the first cylindrical body with both ends thereof projecting, one end side of the chuck being removably screwed to the second cylindrical body and the other end side holding the optical connector, the force of the chuck to hold the optical connector being adjustable.

Preferably, the holding fixture further comprises adjusting means for adjusting the depth of polishing of the end face of each held optical connector, and the adjusting means is a fine-pitch adjusting nut screwed to the outer periphery of the first cylindrical body adjacent to the second cylindrical body.

Further preferably, the holding fixture further comprises a third cylindrical body located outside the second cylindrical body, and a holding force transmission mechanism located between the second and third cylindrical bodies, and adapted to transmit the rotatory force of the third cylindrical body to the second cylindrical body and to interrupt further transmission of the rotatory force in a predetermined direction when a predetermined value is exceeded by the rotatory force.

Preferably, the holding force transmission mechanism includes a fourth cylindrical body located between the second and third cylindrical bodies and adapted to rotate in association with the third cylindrical body, a sliding member in engagement with the fourth cylindrical body, at a projecting portion thereof formed on the fourth cylindrical body side, and slidable in the axial direction of the second cylindrical body, and a pressure member for pressing the sliding member toward the fourth cylindrical body.

Further preferably, the holding fixture further comprises adjusting means for adjusting the depth of polishing of the end face of each held optical connector, and the adjusting means is a fine-pitch adjusting nut screwed to the outer periphery of the first cylindrical body adjacent to the second cylindrical body.

In the end machining apparatus according to the present invention, the removing section removes the adhesive agent swollen on the end faces of the optical connectors, and the polishing section grinds and polishes the end faces of the optical connectors cleared of the adhesive agent by means of the removing section. The switching section shifts the holding member to the removing section or the polishing section. The holding member releasably holds the optical connectors in a manner such that the end face of each optical connector projects, and causes the respective projecting end faces of the optical connectors to move integrally toward and away from the removing section or the polishing section. When the holding member is shifted by means of the switching section, the optical connectors held by means of the holding member are collectively shifted to the removing section or the polishing section.

In the removing section, at this time, the removing member is rotated by means of the first rotating means, thereby removing the adhesive agent swollen on the end faces of the optical connectors.

The grinding material, which is arranged in the circumferential direction on the removing member, and is narrower than the end face of each optical connector and wider than the deposit area of the adhesive agent, grinds and removes only the adhesive agent which is swollen on the end faces of the optical connectors.

The polishing member of the polishing section revolves both on its own axis and around the input shaft, rotated by means of the second rotating means, through the medium of the gear mechanism, thereby grinding and polishing the end faces of the optical connectors, along with those of optical fibers.

The holding member is fitted with holding fixtures which hold the optical connectors individually in the fitting holes arranged at the predetermined intervals in the circumferential direction.

The force of each holding fixture to hold the optical connector is adjusted by regulating the depth of engagement between the second cylindrical body and the chuck.

The adjusting nut serving as the adjusting means attached to each holding fixture adjusts the depth of polishing of each optical connector.

The holding force transmission mechanism of the holding fixture transmits the rotatory force of the third cylindrical body to the second cylindrical body, and interrupts further transmission of the rotatory force in the predetermined direction, thereby keeping the force to hold the optical connector at a predetermined value or below, when the predetermined value is exceeded by the rotatory force.

In a preferred aspect of the end machining apparatus described above, the machining time for the optical connectors can be shortened to improve the productivity, and the optical connectors can be machined at low cost without scratching the end faces of the optical fibers.

Since the removing member is provided in the removing section of the end machining apparatus, moreover, the end faces of the optical connectors cannot be ground while only the adhesive agent swollen thereon is removed.

Since the grinding material, which is arranged in the circumferential direction on the removing member, is narrower than the end face of each optical connector and wider than the deposit area of the adhesive agent, furthermore, only the adhesive agent swollen on the end faces can be removed.

Since the polishing member of the polishing section revolves both on its own axis and around the input shaft, rotated by means of the second rotating means, through the medium of the gear mechanism, the end faces of the optical connectors can be evenly ground and polished, thus enjoying a satisfactory finish of end machining.

Moreover, the holding member is provided with the fitting holes which are arranged at the predetermined intervals in the circumferential direction, and in which the holding fixtures individually holding the optical connectors are fitted. Accordingly, the respective end faces of the optical connectors can be machined collectively, so that the efficiency of the end machining is improved by a large margin.

In a preferred aspect of the holding fixture used in the end machining apparatus described above, each optical connector can be held securely, so that high-accuracy end machining can be effected.

Furthermore, the holding fixture is provided with the adjusting means for adjusting the depth of polishing of the end face of each optical connector. In the end machining of the optical connectors, therefore, the depths of grinding and polishing can be controlled with ease, so that the accuracy of connection of the optical connectors can be prevented from lowering due to excessive grinding or polishing.

The above and other objects, features, and advantages of the invention will be more apparent from the ensuing detailed description taken in connection with the accompanying drawings.

DETAILED DESCRIPTION OF THE PREFERRED EMBODIMENTS

An end machining apparatus and a holding fixture for an optical connector according to one embodiment of the present invention will now be described in detail with reference to the accompanying drawings of FIGS. 1 to 15.

Figure 1:
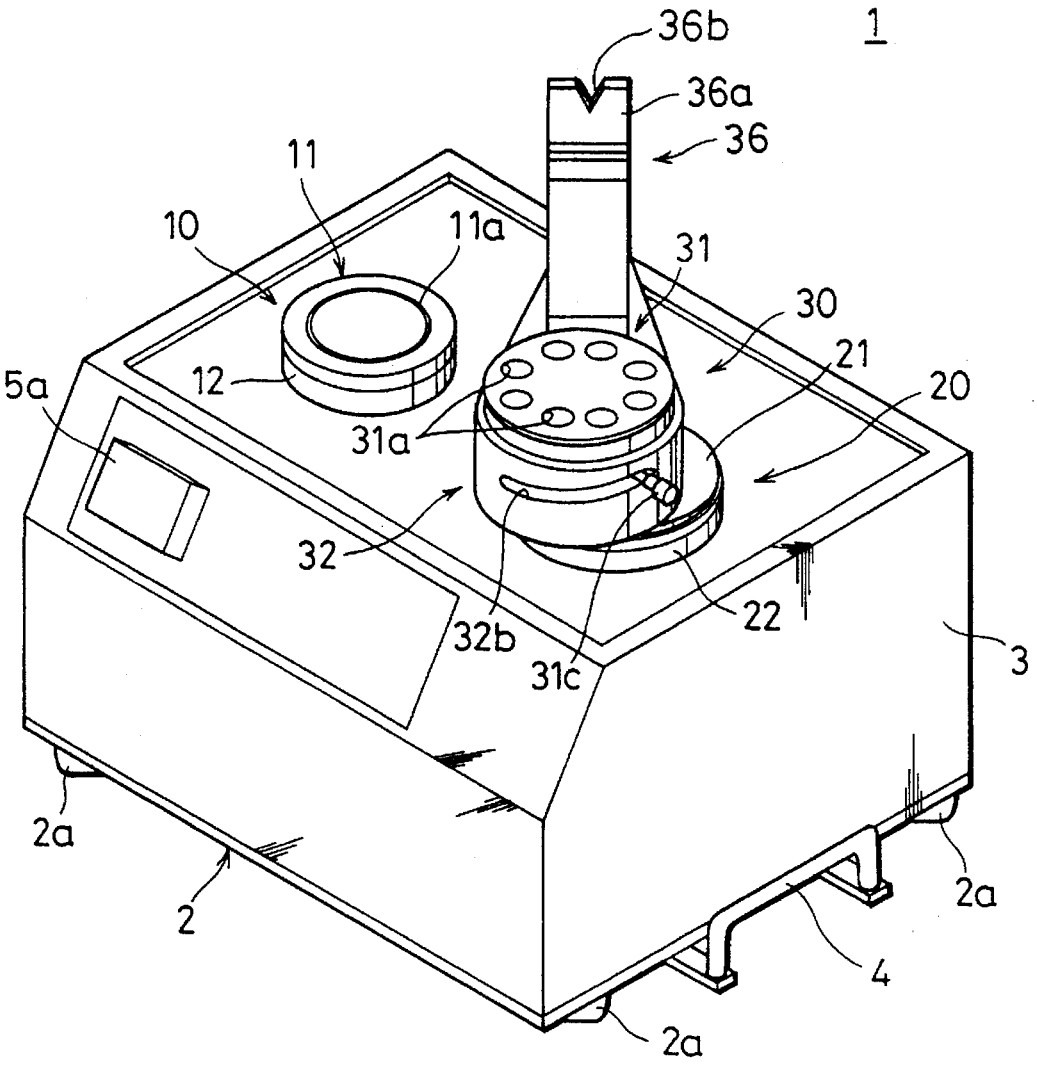
FIG. 1 is a perspective view showing an embodiment of an end machining apparatus for an optical connector according to the present invention.
Figure 2:
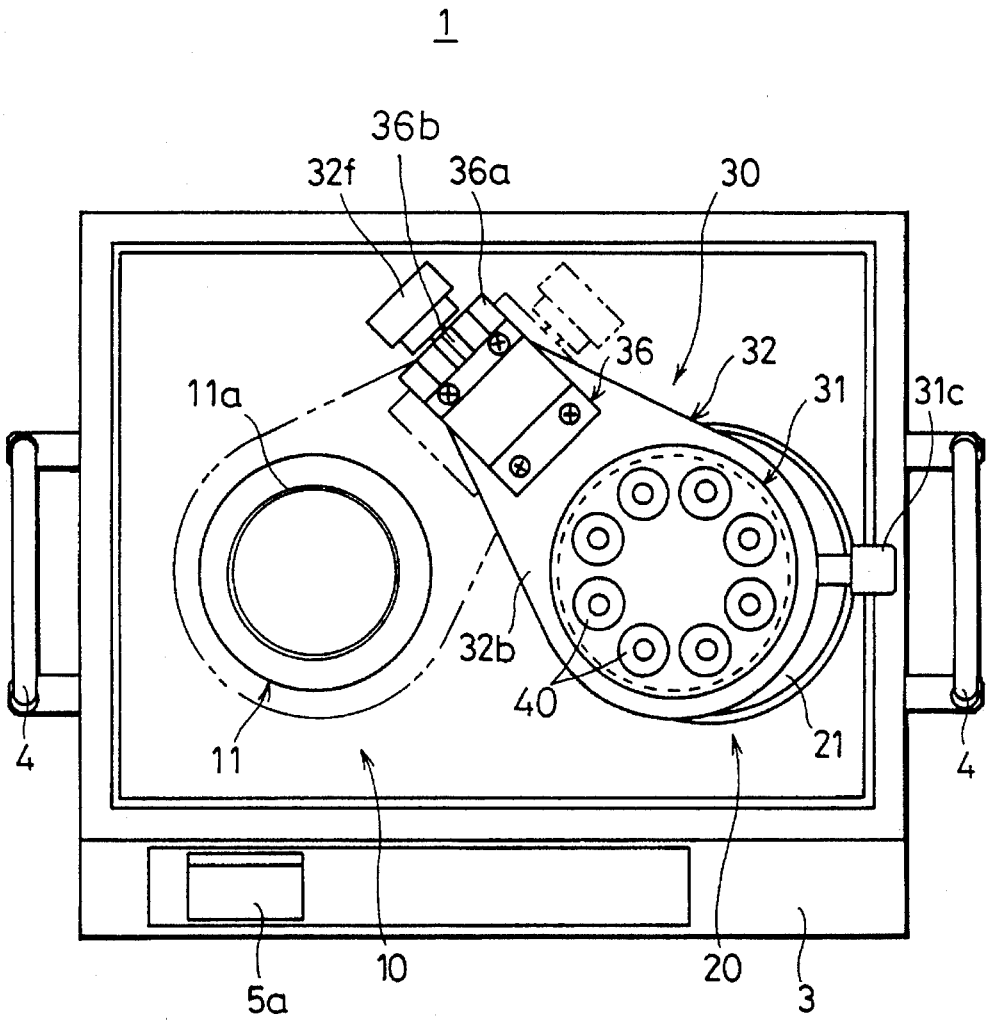
FIG. 2 is a plan view of the end machining apparatus shown in FIG. 1.
Figure 3:
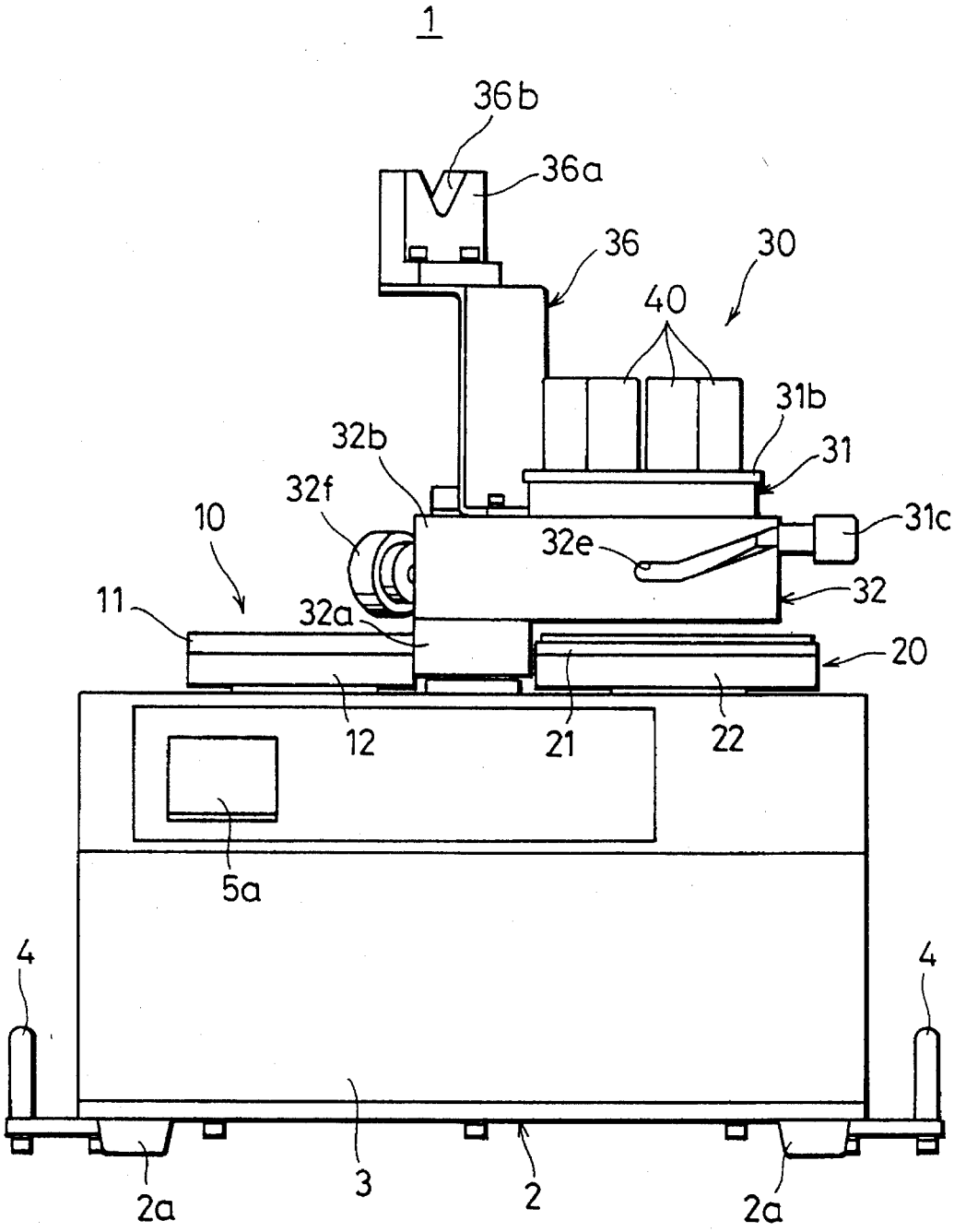
FIG. 3 is a front view of the end machining apparatus shown in FIG. 1.

As shown in FIGS. 1 to 3, an optical connector end machining apparatus (hereinafter referred to as "machining apparatus") 1 comprises a housing 3, a removing section 10, a polishing section 20, and a switching section 30. The box-shaped housing 3 is set on a pedestal 2 which has rubber legs 2*a* on the four corners thereof, and a pair of grips 4 are attached individually to the opposite sides of the pedestal 2.

The top of the housing 3 is somewhat depressed, and a push-button 5*a* of a switch 5 for starting the machining apparatus 1 is provided on the front face of the housing 3. The switch 5 is connected in parallel with limit switches 38 and 39 (mentioned later) of the switching section 30.

Figure 4:
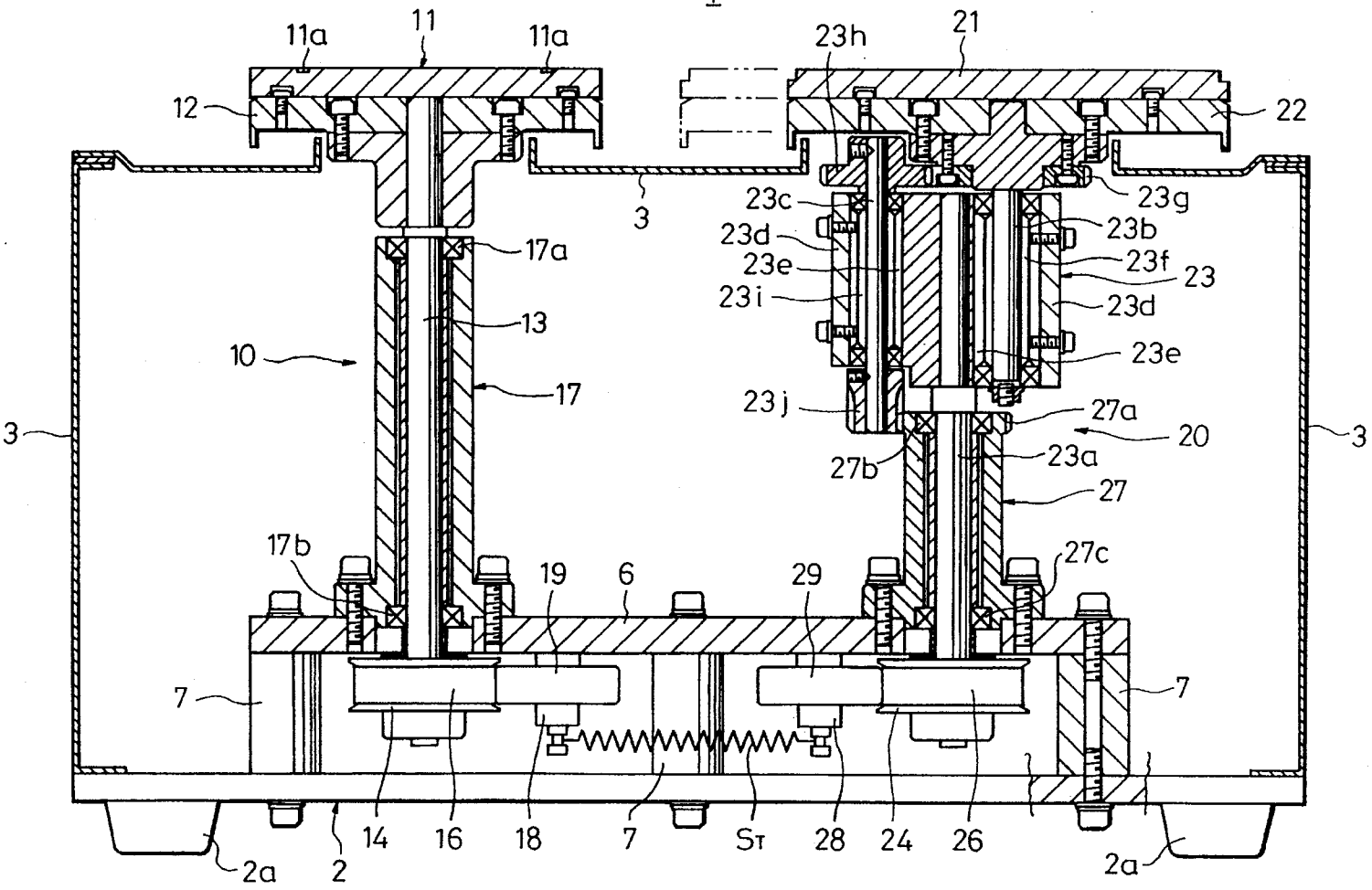
FIG. 4 is a front view, partially in section, showing a removing section and a polishing section of the end machining apparatus of FIG. 1.

The removing section 10, which includes a removing plate 11 and a drive motor 15, as shown in FIG. 4, is used to grind and remove an adhesive agent which is swollen on the end face of the optical connector.

The removing plate 11 is a disk which is replaceable according to the applications. A ring-shaped grinding material 11*a* formed of a diamond grindstone or the like is set in the upper surface of the plate 11 shown in FIG. 4. The grinding material 11*a* is narrower than an end face 50*a* of an optical connector 50 (see FIG. 9) and wider than a deposit area of the adhesive agent. The upper surface of the grinding material 11*a* is flush with or a little lower than that of the removing plate 11. As shown in FIG. 1, the removing plate 11 is situated on the left-hand side of the top of the housing 3, and is set coaxially on a supporting plate 12 so as to be rotatable integrally therewith. Thus, in machining an optical connector having a slanting end face, for example, the removing plate 11 can be easily-replaced with another one by being lifted up to be disengaged from the supporting plate 12. As shown in FIG. 4, the center of the supporting plate 12 is supported on the upper end of a supporting shaft 13.

Figure 7:
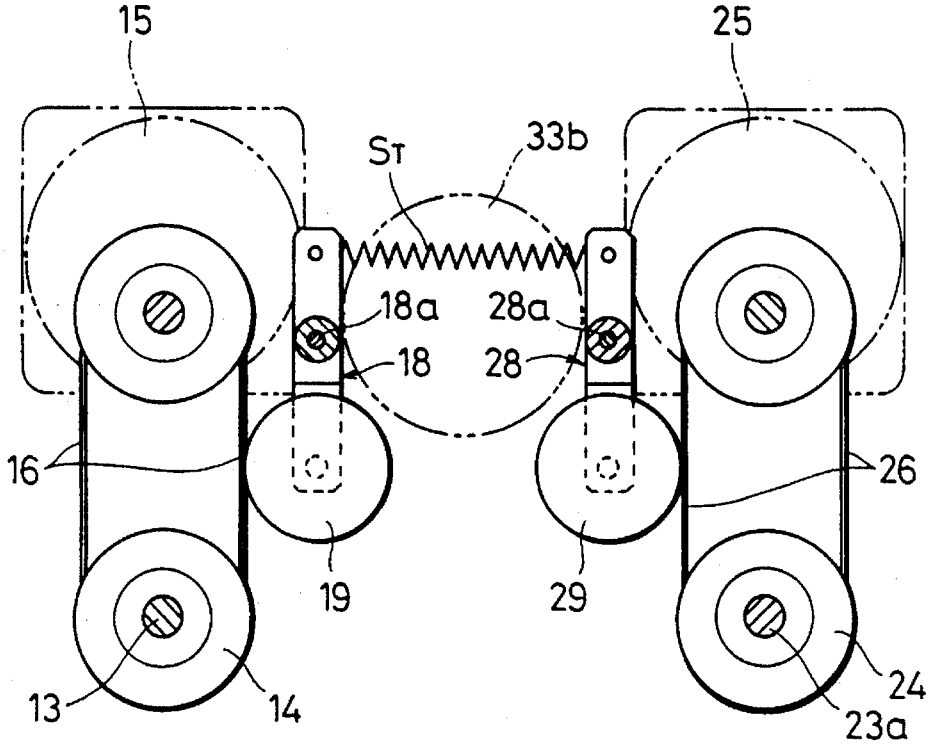
FIG. 7 is a plan view, partially in section, showing a state in which a tension is applied to each of timing belts for rotating the removing section and the polishing section of the end machining apparatus.

A pulley 14 is mounted on the lower end of the supporting shaft 13, as shown in FIG. 4, and the pulley 14 and the drive motor 15 are connected by means of a timing belt 16, as shown in FIG. 7. As shown in FIG. 4, the supporting shaft 13 is rotatably supported in a supporting cylinder 17 by means of bearings 17*a* and 17*b*, and the cylinder 17 is set up on a base 6. The base 6 is supported in the housing 3 by means of a plurality of stanchions 7 on the pedestal 2. As shown in FIG. 7, the timing belt 16 is in contact with a plastic bearing 19, which is rotatably supported on one end of a rocking arm 18, and is subjected to a tension by means of a tension spring $S_T$, which will be mentioned later. A substantially middle portion of the rocking arm 18 is rockably mounted on the lower surface of the base 6 by means of a hinge pin 18*a*.

The polishing section 20, which is located adjacent to the removing section 10, is used to grind and polish the end face of the optical connector, cleared of the adhesive agent, along with the respective end faces of a plurality of optical fibers. The polishing section 20 includes a polishing plate 21, a planetary gear mechanism 23, and a drive motor 25.

The polishing plate 21 is situated on the right-hand side of the top of the housing 3, and is set coaxially on a supporting plate 22 so as to be rotatable integrally therewith. The polishing plate 21 is replaced depending on the finish of the ground and polished end face of the optical connector. More specifically, the end face is first ground by means of a #2,000 diamond grindstone (diamond grain size: 3 to 8 μm), and then polished with use of diamond abrasive grains with the average grain size of 1 μm. Further, the end face is subjected to final polishing, using a buff sheet and cerium oxide with the average grain size of 1 μm, to be finished into a specular surface. Thus, the end face of the optical connector is ground and polished as required.

The center of the supporting plate 22 is supported on the upper end of an output shaft 23*b* which constitutes the planetary gear mechanism 23.

The planetary gear mechanism 23 comprises an input shaft 23*a*, the output shaft 23*b*, an intermediate shaft 23*c*, an internal gear 23*d* formed of a cylinder having teeth inside, and a first sun gear 23*e* mounted on the input shaft 23*a*. The mechanism 23 further comprises a first planetary gear 23*f* and a first gear 23*g* mounted on the output shaft 23*b*, a second gear 23*h* and second and third planetary gears 23*i* and 23*j* mounted on the intermediate shaft 23*c*, and a second sun gear 27*a* formed on the outer peripheral surface of the top portion of a supporting cylinder 27 (mentioned later).

The first sun gear 23e, first gear 23g, second planetary gear 23i, and third planetary gear 23j are in mesh with the first planetary gear 23f, second gear 23h, first sun gear 23e, and second sun gear 27a, respectively. The polishing plate 21 is caused to revolve both around the input shaft 23a and on its own axis by a rotatory force transmitted from the drive motor 25 (mentioned later) to the output shaft 23b.

As shown in FIG. 4, moreover, the input shaft 23a is fitted with a pulley 24 at its lower end. As shown in FIG. 7, the pulley 24 and the drive motor 25 are connected by means of a timing belt 26. As shown in FIG. 4, furthermore, the input shaft 23a is rotatably supported in the supporting cylinder 27 by means of bearings 27b and 27c, and the cylinder 27 is set up on the base 6.

The drive motor 25, which is formed of an induction motor, for example, is set on a gear box $B_G$ which is mounted on the base 6. The rotatory force of the motor 25 is transmitted to the timing belt 26 through a gear train (not shown) for speed variation in the gear box $B_G$.

As shown in FIG. 7, the timing belt 26 is in contact with a plastic bearing 29, which is rotatably supported on one end of a rocking arm 28, and is subjected to a tension by means of the tension spring $S_T$, which is stretched between the respective other ends of the rocking arms 18 and 28. A substantially middle portion of the rocking arm 28 is rockably mounted on the lower surface of the base 6 by means of a hinge pin 28a.

Figure 8:
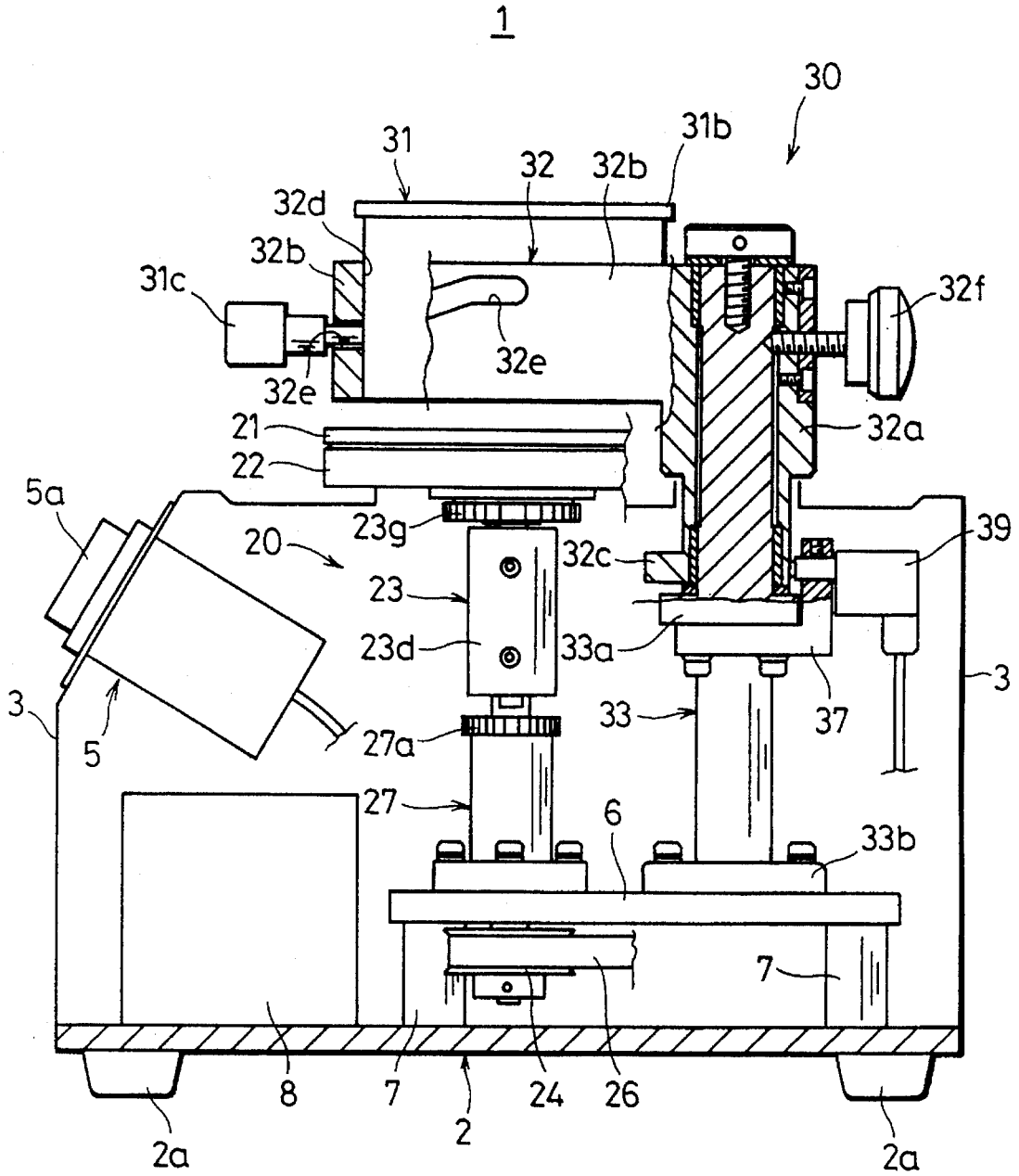
FIG. 8 is a cutaway side view showing the configuration of the switching section.

The switching section 30 is used to shift a plurality of optical connectors for end machining collectively between the removing section 10 and the polishing section 20. As shown in FIG. 8, the switching section 30 includes a disk 31, holder arm 32, and stanchion 33.

As shown in FIG. 1, the disk 31 is vertically penetrated by six fitting holes 31a arranged at regular intervals in the circumferential direction, and is removably mounted on the holder arm 32. The disk 31 is formed having a flange 31b (see FIG. 8) which projects slightly outward in the radial direction from its top portion. An operating lever 31c is pivotally mounted on the side wall of the disk 31 through a guide hole 32e which is formed in the holder arm 32. A collet chuck 40, which holds an optical connector as an object of machining on its distal end, is passed through each fitting hole 31a.

Figure 9:
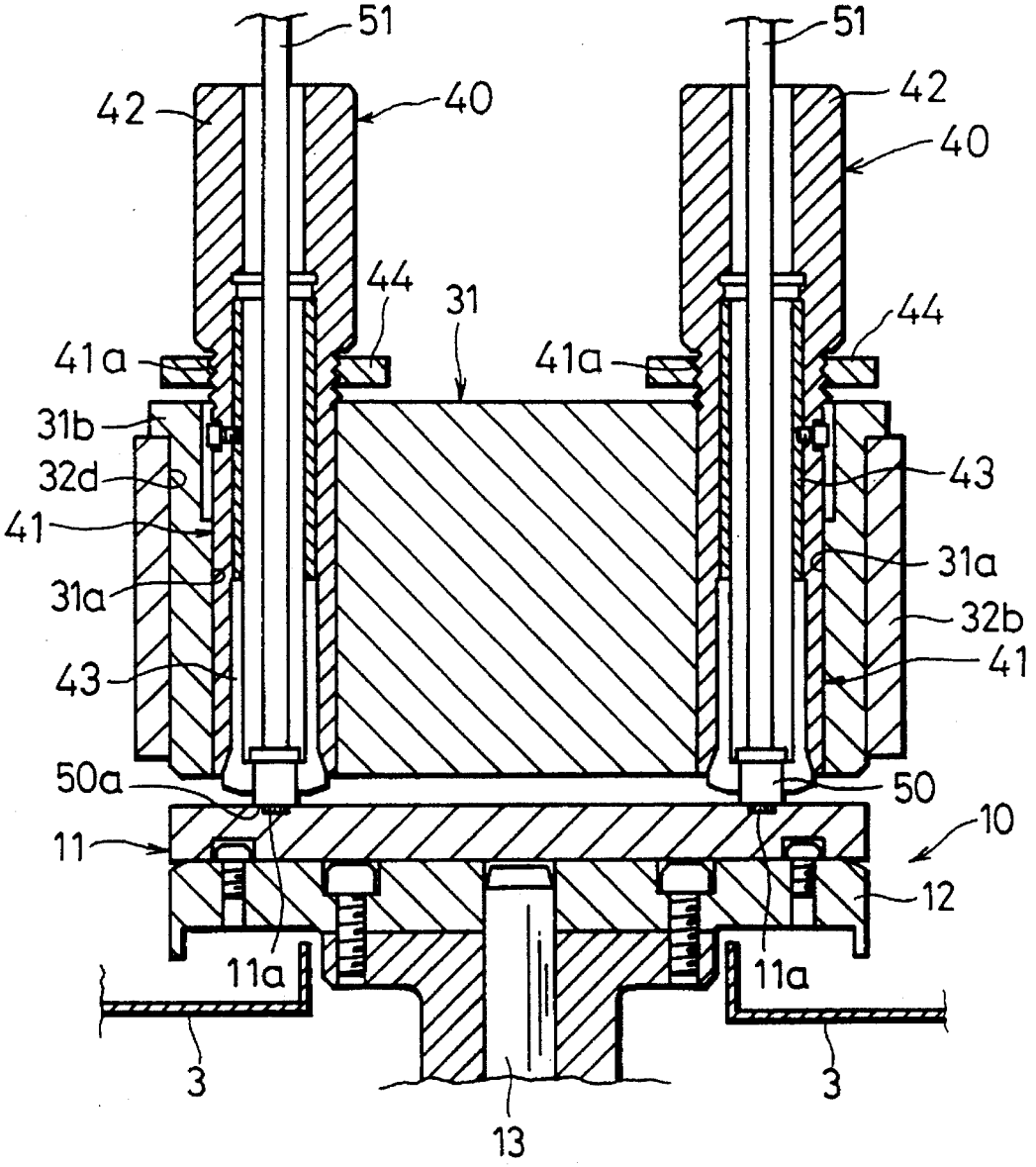
FIG. 9 is a sectional view showing the relationship between the removing section and optical connectors set in the switching section.
Figure 10:
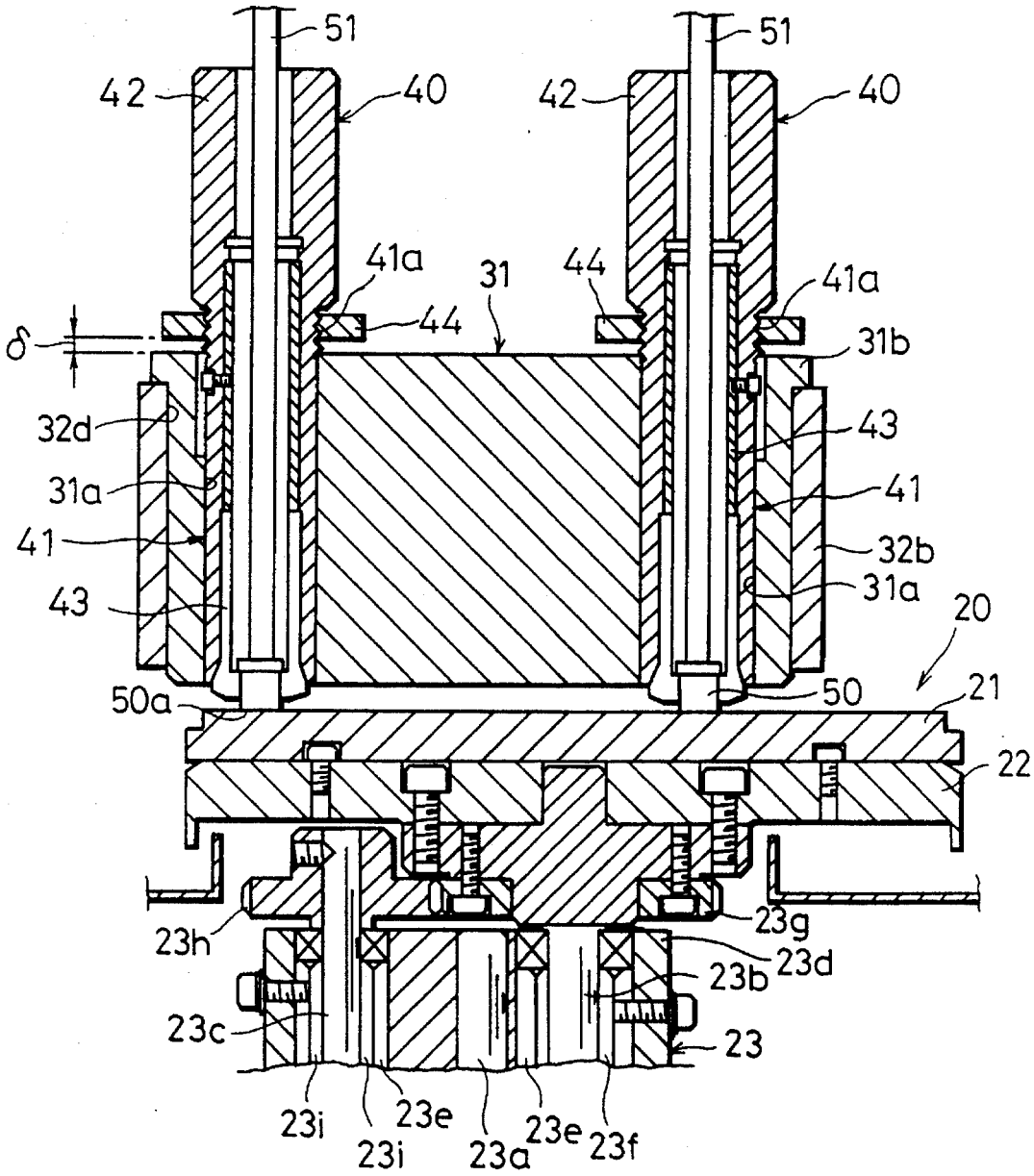
FIG. 10 is a sectional view showing the relationship between the polishing section and the optical connectors set in the switching section.
Figure 11:
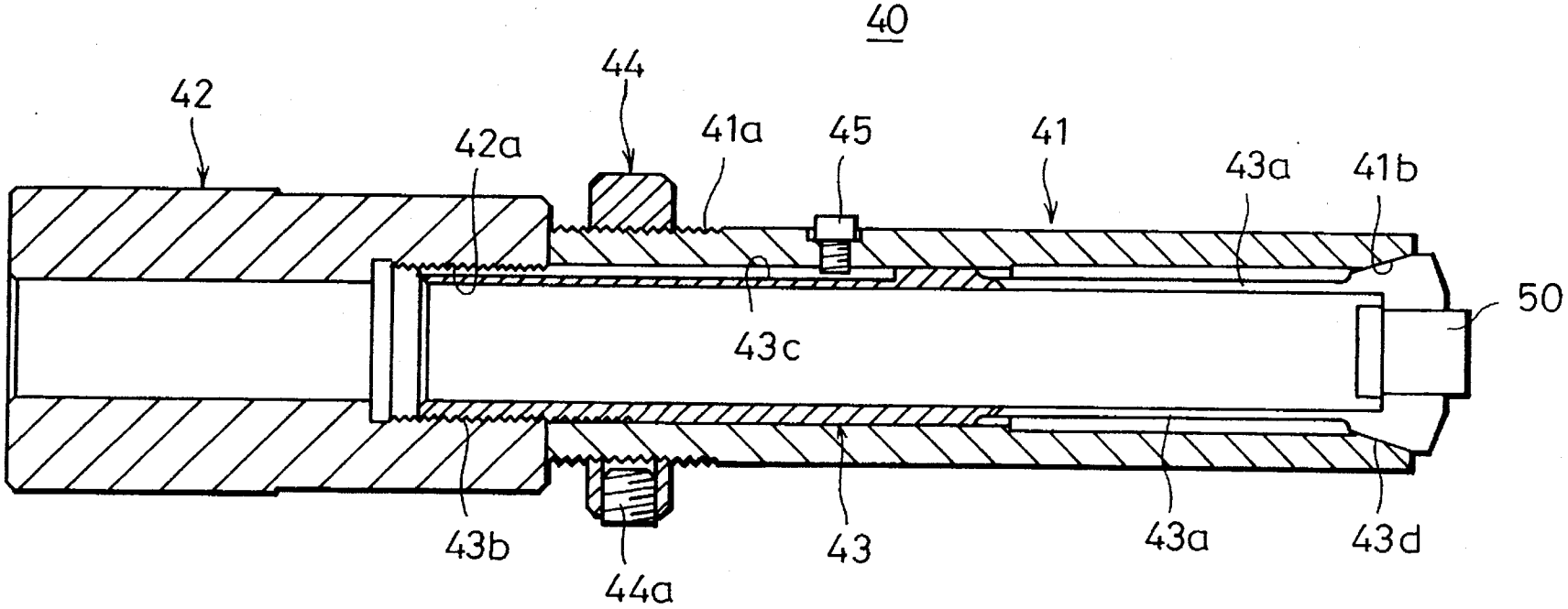
FIG. 11 is a sectional view showing an optical connector holding fixture used in the end machining apparatus.

The collet chuck 40 is a holding fixture which has an adjustable holding force for optical connector. As shown in FIGS. 9 to 11, the collet chuck 40 includes lower and upper cylinders 41 and 42, arranged adjacent to each other, and a chuck 43. The cylinders 41 and 42 and the chuck 43 are assembled integrally by screwing a male thread portion 43b (mentioned later) at the upper portion of the chuck 43 into a female thread portion 42a (mentioned later) formed on the upper cylinder 42.

The lower cylinder 41 is a hollow cylinder which is united with the upper cylinder 42 by means of the chuck 43. A fine-pitch thread portion 41a is formed on the outer periphery of the upper part of the cylinder 41, and a downwardly spreading taper portion 41b is formed on the inner surface of the lower part. A setscrew 45 is attached to the lower cylinder 41 in the vicinity of the thread portion 41a in a manner such that its tip end projects inward. An adjusting nut 44 for adjusting the depth of polishing is screwed on the thread portion 41a.

The upper cylinder 42 is a hollow cylinder which has an outside diameter larger than that of the lower cylinder 41 and an inside diameter substantially equal to that of the chuck 43. The female thread portion 42a is formed on the inside of the lower part of the upper cylinder 42.

The chuck 43 includes four holding claws 43a inserted in the lower cylinder 41 with their ends projecting on each side, a male thread portion 43b formed on the outer periphery of its top portion, and a retaining groove 43c formed on its upper portion so as to extend in the longitudinal direction. The claws 43a are formed by dividing the lower near-half portion of a hollow cylinder in four. Each claw 43a has a taper surface 43d on the outside of its distal end, corresponding in shape to the taper portion 41b of the lower cylinder 41.

The adjusting nut 44 is used properly to adjust the depth of polishing of the end face of the optical connector 50. The nut 44 is previously screwed on the thread portion 41a of the lower cylinder 41, and can be fixed in a desired position on the thread portion 41a by means of a fixing screw 44a.

The collet chuck 40 thus constructed is assembled in the following manner.

First, the optical connector 50 is inserted into the chuck 43 and held by means of the four holding claws 43a.

Then, the chuck 43, holding the optical connector 50 therein, is inserted into the lower part of the lower cylinder 41 with the male thread portion 43b forward in a manner such that the tip end of the setscrew 45 is situated corresponding to the retaining groove 43c, and the male thread portion 43b is caused to project from the top of the lower cylinder 41.

Subsequently, the upper cylinder 42 is rotated in this state as the female thread portion 42a is screwed on the male thread portion 43b of the chuck 43.

Since the tip end of the setscrew 45 projects into the retaining groove 43c, the lower cylinder 41 and the chuck 43 are restrained from rotating relatively to each other. As the upper cylinder 42 is rotated so that the female thread portion 42a engages the male thread portion 43b deeper and deeper, therefore, the chuck 43 is gradually pulled up to the side of the upper cylinder 42.

When the taper surface 43d of each holding claw 43a of the chuck 43 abuts against the taper portion 41b, the four holding claws 43a are guided to be contracted by the taper portion 41b. Thus, the optical connector 50 is securely held by means of the four holding claws 43a.

In the collet chuck 40, therefore, the force of the four holding claws 43a to hold the optical connector 50 can be adjusted by suitably controlling the rotational displacement of the upper cylinder 42 after the taper surface 43d of each claw 43a comes into contact with the taper portion 41b.

Figure 12:
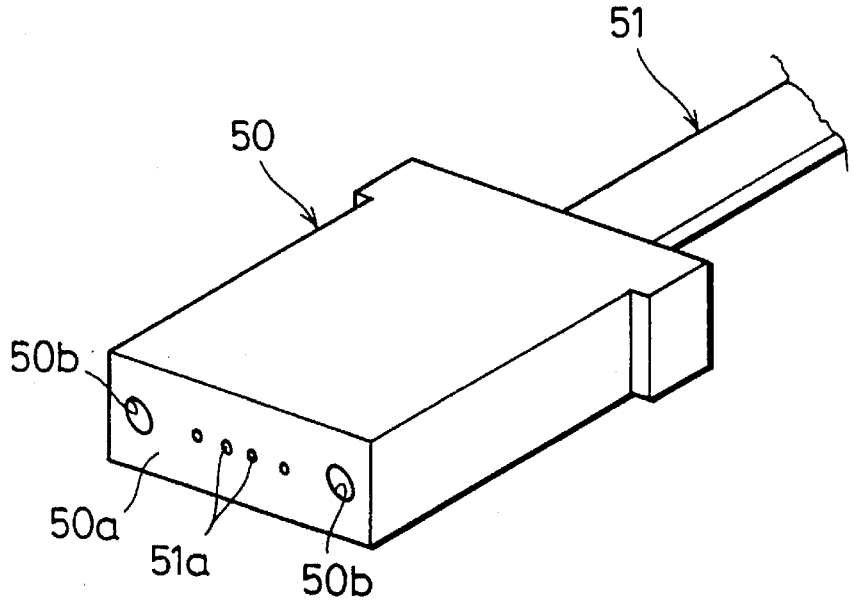
FIG. 12 is a perspective view showing an example of the optical connector subjected to end machining.

As shown in FIG. 12, the optical connector 50 is attached to an end portion of a tapefiber 51. A plurality of optical fibers 51a of the tapefiber 51 are bonded to fiber holes by means of an adhesive agent, and their respective distal ends are exposed on the end face 50a. A pair of pin holes 50b are formed on either side of the exposed optical fibers 51a.

Figure 6:
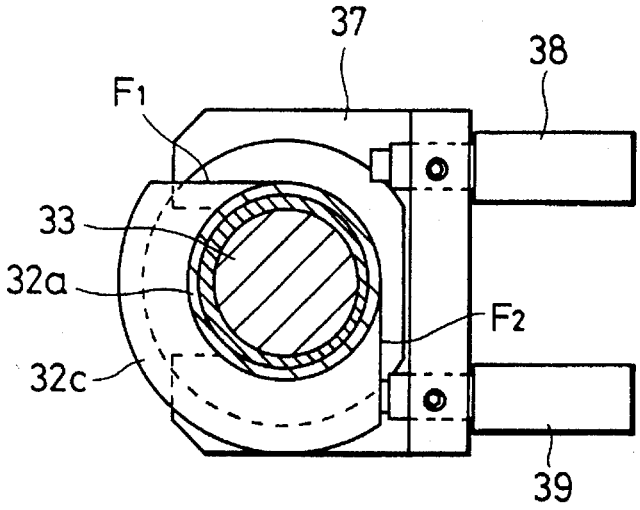
FIG. 6 is a plan view showing the relationship between a switching flange formed on a holder arm of a switching section and limit switches, taken along a sectional plane perpendicular to a stanchion.

As shown in FIG. 8, the holder arm 32 is composed of a supporting cylinder 32a, rotatably fitted on the upper portion of the stanchion 33, and an arm 32b integral therewith for supporting the disk 31 for up-and-down motion. The supporting cylinder 32a can rotate within a range of 90° around the stanchion 33 such that the arm 32b rocks between positions right over the removing plate 11 and the polishing plate 21, as shown in FIG. 1. A substantially fan-shaped switching flange 32c is formed on the lower part of the cylinder 32a. As shown in FIG. 6, the switching flange 32c has pressure surfaces $F_1$ and $F_2$ individually on its two side faces and a central angle of 90°. As shown in FIG. 8, moreover, the arm 32b has an opening 32d in the center, in which the disk 31 is removably mounted, and a guide slot 32*e* is formed in the side wall of the arm 32*b* so as to open into the opening 32*d*. Both ends of the guide slot 32*e* extend horizontally, and a slanting portion extends between them. Thus, the slot 32*e* guides the operating lever 31*c* to move the disk 31 up and down. The holder arm 32 is fixed to the stanchion 33 by means of a setscrew 32*f* which is attached to the supporting cylinder 32*a*.

As shown in FIGS. 1 to 3, moreover, a crank-shaped supporting bracket 36 is set up on the proximal end portion of the holder arm 32 on the side of the stanchion 33, and a fiber guide 36*a* with a V-groove 36*b* is mounted on the top portion of the bracket 36. The V-groove 36*b* of the fiber guide 36*a* receives a plurality of tapefibers, which extend from the optical connector held by means of the collet chuck 40, when the chuck 40 is passed through each fitting hole 31*a* of the disk 31, lest the fibers break up.

As shown in FIG. 8, the stanchion 33 is a columnar member which has a flange 33*a* substantially in the center, and is set on the base 6 by means of a setting flange 33*b* at the bottom. The stanchion 33 supports the supporting cylinder 32*a* of the holder arm 32 for rotation so that the disk 31 can be shifted between the removing section 10 and the polishing section 20. Moreover, a supporting member 37 is mounted on the lower surface of the flange 33*a* of the stanchion 33. As shown in FIGS. 6 and 8, limit switches 38 and 39 are attached to the supporting member 37.

The limit switches 38 and 39 are turned on or off by means of the pressure surfaces $F_1$ and $F_2$ of the switching flange 32*c*, respectively, depending on the shift position of the holder arm 32. When the holder arm 32 is on the side of the polishing section 20, as shown in FIG. 6, for example, the limit switch 39 is turned on by means of the pressure surface $F_2$, and the limit switch 38, which is separated from the pressure surface $F_1$, is off.

Thus, when the holder arm 32 is shifted to the side of the polishing section 20, in the machining apparatus 1, the drive motor 25 of the section 20 is actuated to cause the polishing plate 21 to revolve both around the input shaft 23*a* and on its own axis, while the drive motor 15 of the removing section 10 is not actuated, so that the removing plate 11 is at a standstill.

When the holder arm 32 is shifted to the side of the removing section 10, on the other hand, the switching flange 32*c* rotates together with the supporting cylinder 32*a*. Thereupon, the pressure surface $F_2$ is separated from the limit switch 39, so that the switch 39 is turned off, while the limit switch 38 is pressed and turned on by the pressure surface $F_1$. Thus, in the machining apparatus 1, the drive motor 25 of the polishing section 20 is stopped, so that the revolutions of the polishing plate 21 on its own axis and around the input shaft 23*a* are stopped, while the drive motor 15 of the removing section 10 is actuated to start the rotation of the removing plate 11.

Figure 5:
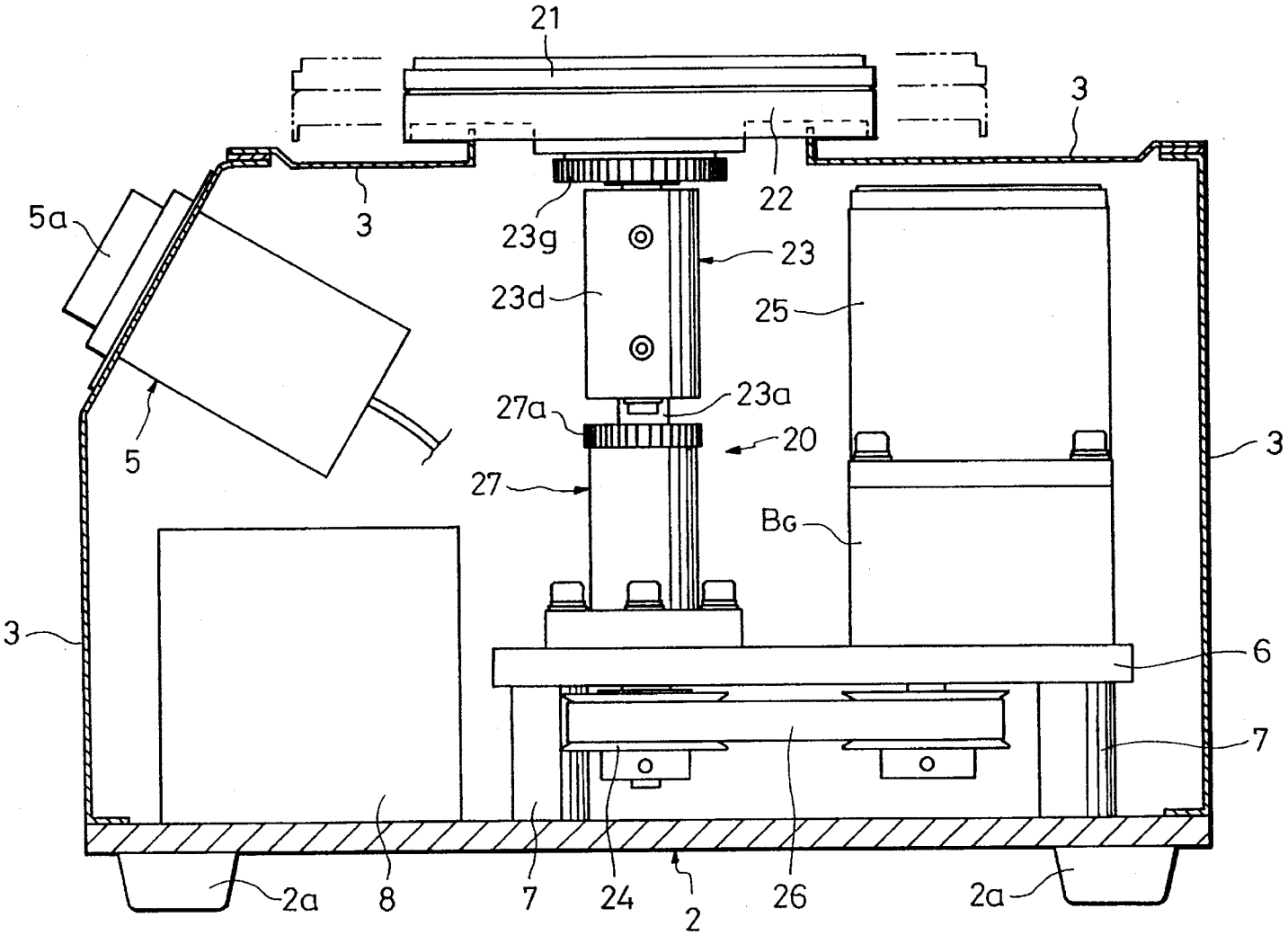
FIG. 5 is a side view, partially in section, showing the polishing section of the end machining apparatus of FIG. 1.

The drive motors 15 and 25 are driven at a predetermined operating voltage which is obtained by transforming an input voltage from an external power source by means of a transformer 8. As shown in FIGS. 5 and 8, the transformer 8 is set on the pedestal 2 in the housing 3.

Constructed in this manner, the machining apparatus 1 and the collet chuck 40 are used in the following manner.

First, the holder arm 32 is shifted to the side of the removing section 10, and the operating lever 31*c* is rocked in the counterclockwise direction to raise the disk 31. In this state, each collet chuck 40, holding the optical connector as the object of machining, is fitted in each corresponding fitting hole 31*a* of the disk 31. At this time, the tape fibers of the optical connector extending from the collet chuck 40 are housed in the V-groove 36*b* of the fiber guide 36*a* on the supporting bracket 36 lest they break up.

Then, the push-button 5*a* on the front face of the housing 3 is depressed to start the operation of the machining apparatus 1. As the holder arm 32 is shifted to the side of the removing section 10, the pressure surface $F_1$ of the switching flange 32*c* abuts against the limit switch 38 to turn it on, while the pressure surface $F_2$ is separated from the limit switch 39 to turn it off. Accordingly, the removing section 10 is actuated, the polishing section 20 is stopped, and the removing plate 11 starts to be rotated by means of the drive motor 15.

Subsequently, the operating lever 31*c* is rocked in the clockwise direction to lower the disk 31. Thereupon, the collet chuck 40 descends together with the disk 31, so that the end face 50*a* of the optical connector 50 is pressed against the upper surface of the removing plate 11 by the weight of the chuck 40, as shown in FIG. 9. As a result, the end face 50*a* of the optical connector 50 to be machined is situated right over the grinding material 11*a*, and the adhesive agent swollen on the end face 50*a* is ground and removed by means of the grinding material 11*a*.

Since the grinding material 11*a* is narrower than the end face 50*a* of the optical connector 50 and wider than the adhesive deposit area, the adhesive agent on the end face 50*a* is removed thoroughly.

In the removing section 10, the upper surface of the grinding material 11*a* is flush with or a little lower than that of the removing plate 11. Therefore, the progress of the grinding operation is stopped when the quantity of the adhesive agent remaining on the end face 50*a* is very small or when a layer of the adhesive agent has just disappeared. Thus, the depth of grinding never varies depending on the quantity of the adhesive agent.

When the blanket removal of the adhesive agent from the respective end faces 50*a* of the optical connectors 50 is finished in this manner, the operating lever 31*c* is rocked in the counterclockwise direction to raise the disk 31. When the holder arm 32 is then rocked around the supporting cylinder 32*a* so that the switching section 30 is shifted to the side of the polishing section 20, the optical connectors 50 are collectively shifted from the removing section 10 to the polishing section 20.

As this is done, the supporting cylinder 32*a* is rotated so that the limit switch 39 is turned on by means of the pressure surface $F_2$, and the limit switch 38, which is separated from the pressure surface $F_1$, is turned off.

Thereupon, the drive motor 25 of the polishing section 20 is actuated, so that the polishing plate 21 starts to revolve both around the input shaft 23*a* and on its own axis, while the drive motor 15 of the removing section 10 is stopped, so that the rotation of the removing plate 11 stops. In this state, the operation of the machining apparatus 1 is stopped, and the depth of polishing is regulated in the following manner.

First, the operating lever 31*c* is rocked in the clockwise direction to lower the disk 31, whereupon the end face 50*a* of the optical connector 50 held by means of each collet chuck 40 comes into contact with the upper surface of the polishing plate 21, as shown in FIG. 10. At this time, the depth of polishing is adjusted in accordance with the distance $\delta$ of the gap between the adjusting nut 44 on the thread portion 41*a* of the chuck 40 and the upper surface of the disk 31.

More specifically, the adjusting nut 44 is rotated in the clockwise direction so that the gap distance $\delta$ shown in FIG.

10 is zero, whereby the nut 44 is brought into contact with the upper surface of the disk 31 (δ=0). Since the adjusting nut 44 on each collet chuck 40 is in contact with the upper surface of the disk 31 in this state, the end face 50*a* of the optical connector 50 can hardly be polished even though the polishing plate 21 is actuated.

Then, the adjusting nut 44 is rotated in the counterclockwise direction for a predetermined angle which depends on the pitch of the thread portion 41*a*, in accordance with a desired depth of polishing, whereby the gap distance δ is adjusted to a predetermined value (δ>0). Thus, in adjusting the depth of polishing to about 30 μm in the case where the pitch of the thread portion 41*a* on the collet chuck 40 is 900 μm, for example, the adjusting nut 44 is rotated for about 12° in the counterclockwise direction to adjust the distance δ to 30 μm.

When the machining apparatus 1 is started after the adjustment of the depth of polishing is finished in this manner, the polishing plate 21 starts to revolve both around the input shaft 23*a* and on its own axis, and the respective end faces 50*a* of the optical connectors 50, pressed against the polishing plate 21 by the weight of the collet chuck 40, are finished together with the optical fibers 51*a* by grinding and polishing to a predetermined depth. In the polishing plate 21, at this time, grinding and polishing are carried out by means of a suitable combination of a polishing grindstone, polishing sheet, polishing paste, etc., depending on the finish.

When the blanket polishing of the optical connectors 50 is finished, the machining apparatus 1 is stopped, the operating lever 31*c* is rocked in the counterclockwise direction to raise the disk 31, each collet chuck 40 is drawn out from its corresponding fitting hole 31*a*, and the machined optical connector 50 is taken out.

Figure 13:
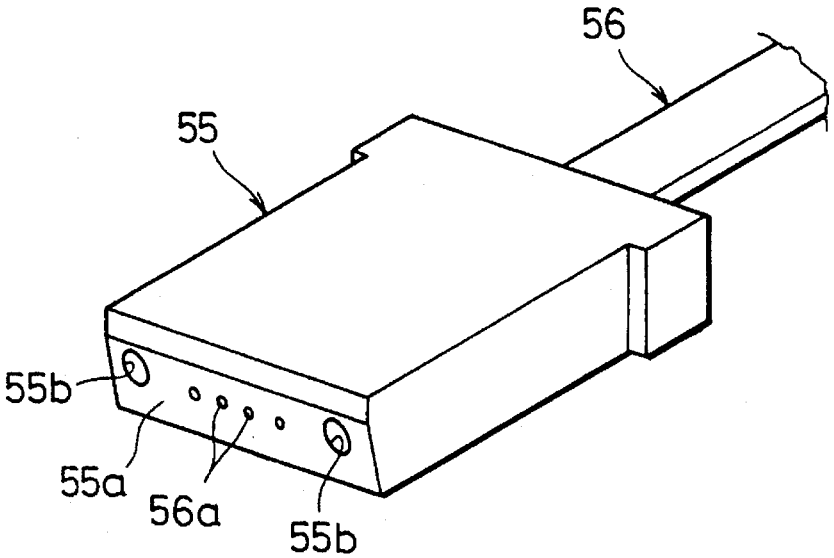
FIG. 13 is a perspective view showing another example of the optical connector subjected to end machining.

In some optical connectors, such as an optical connector 55 shown in FIG. 13, which are attached to the end portions of the tapefibers, an end face 55*a* is ground aslant in order to reduce reflection of signal light transmitted through the optical fibers on the fiber end faces. In this optical connector 55, like he optical connector 50 with the level end face, a plurality of optical fibers 56*a* of a tapefiber 56 are bonded to fiber holes by means of an adhesive agent, and their respective distal ends are exposed on the end face 55*a*. A pair of pin holes 55*b* are formed on either side of the exposed optical fibers 56*a*.

Figure 14:
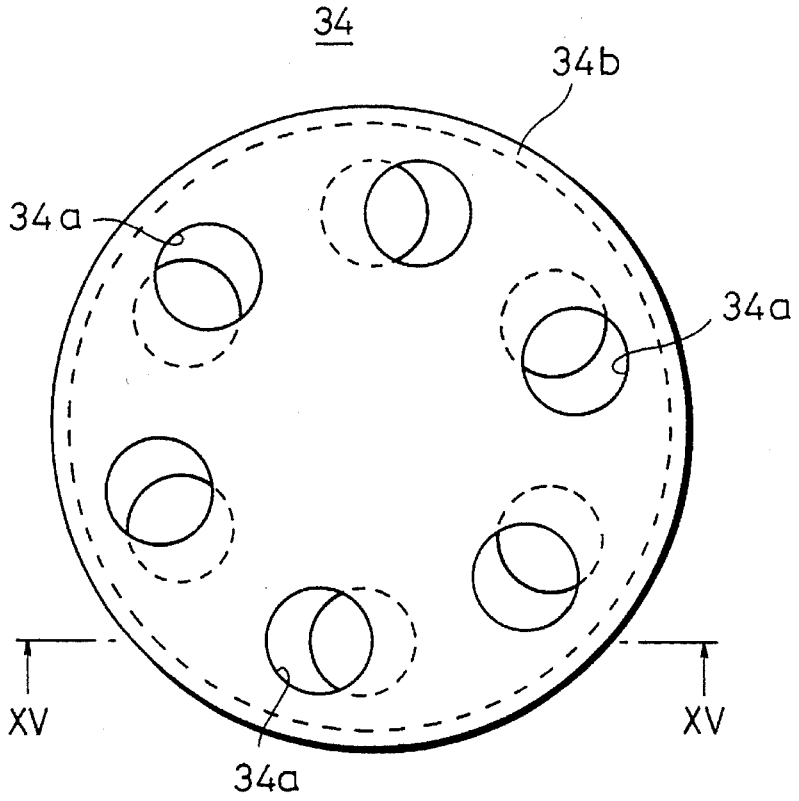
FIG. 14 is a plan view showing a modification of a holding member in the switching section.
Figure 15:
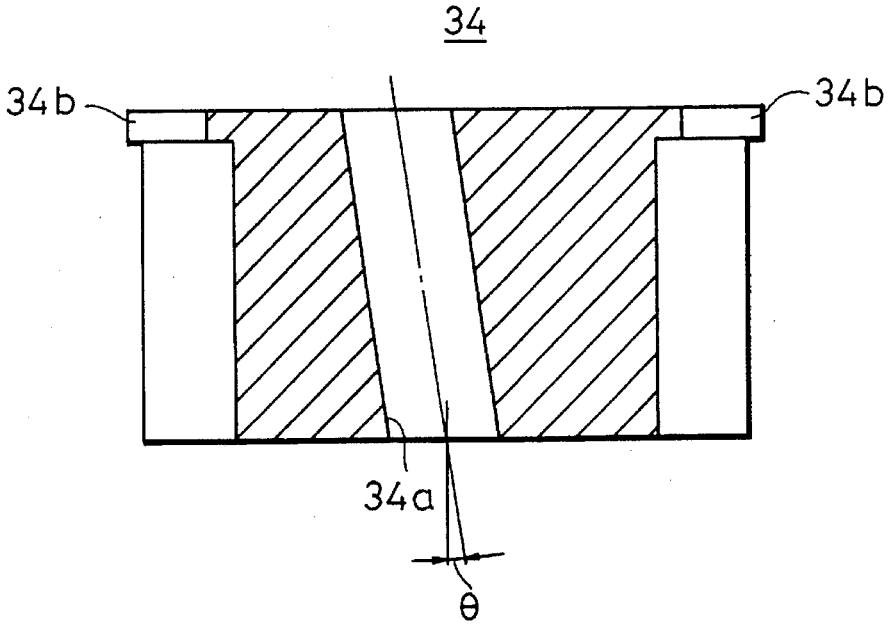
FIG. 15 is a sectional view of the holding member taken along line XV—XV of FIG. 14.

The optical connector 55 with the slanting end face 55*a* is produced by manufacturing an optical connector identical with the optical connector 50 and then end-machining it by means of the machining apparatus 1 using a disk 34 shown in FIGS. 14 and 15.

The disk 34 is provided with six slanting fitting hole 34*a* which are arranged at regular intervals in the circumferential direction and through which the collet chucks 40 are passed individually. A tilt angle θ shown in FIG. 15 is equal to that of the slantly ground end face 55*a*, and is normally adjusted to, e.g., 8°. The disk 34 is constructed in the same manner as the disk 31 except that the fitting holes 34*a* are inclined. In FIGS. 14 and 15, therefore, corresponding reference numerals are used to designate those portions of the disk 34 which correspond to their counterparts of the disk 31, and a detailed description of the disk 34 is omitted.

In machining the optical connectors 50 into the optical connectors 55 with the slanting end face 55*a*, the removing plate 11 of the removing section 10 is replaced with another one whose upper surface is formed of a grinding material, the disk 31 attached to the holder arm 32 of the switching section 30 of the machining apparatus 1 is replaced with the disk 34, and the collet chucks 40 holding the optical connectors 50 are passed through the fitting holes 34*a*, individually. Thereupon, the optical connectors 50 held individually by means of the collet chucks 40 abut against the upper surface of the removing plate 11 or the polishing plate 21 at the tilt angle θ.

First, in end-machining the optical connector 50 by means of the disk 34 following the aforementioned steps of procedure, therefore, the adhesive agent swollen on the end face 50*a* is removed, and the end face 50*a* is ground aslant in the removing section 10.

When the holder arm 32 is then shifted to the side of the polishing section 20, the slantly ground end face 50*a* of the optical connector 50 is polished in the polishing section, whereupon the optical connector 50 is end-machined into the optical connector 55 shown in FIG. 13.

Figure 16:
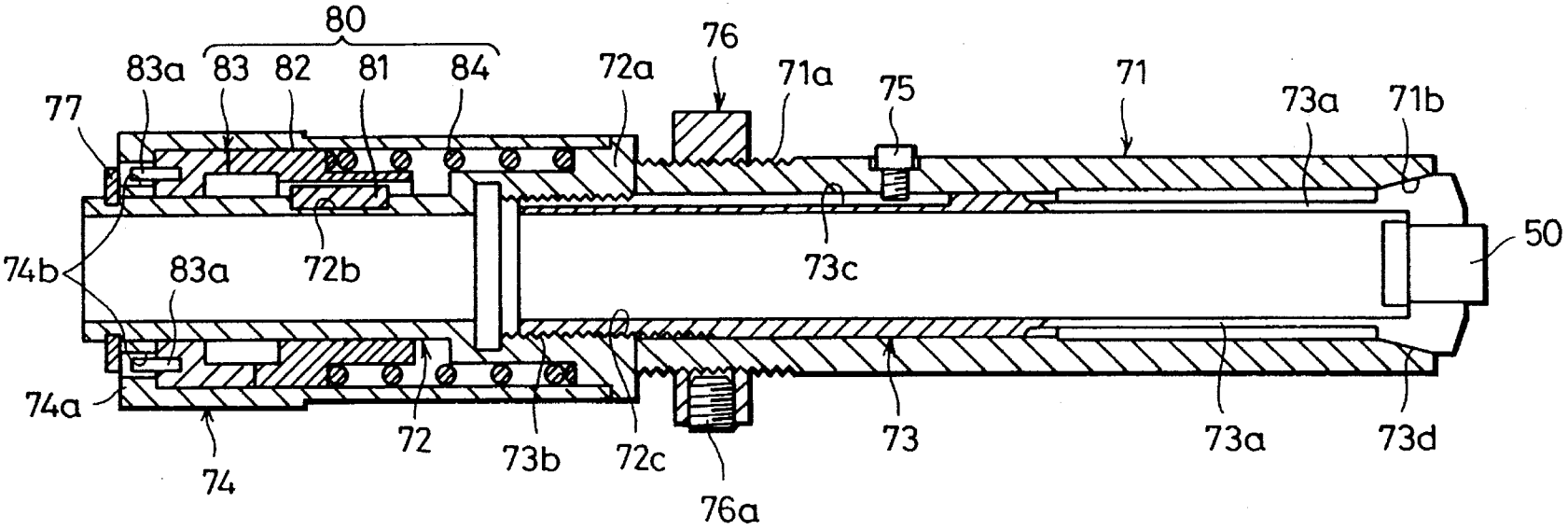
FIG. 16 is a sectional view showing another embodiment of the optical connector holding fixture used in the end machining apparatus.
Figure 17:
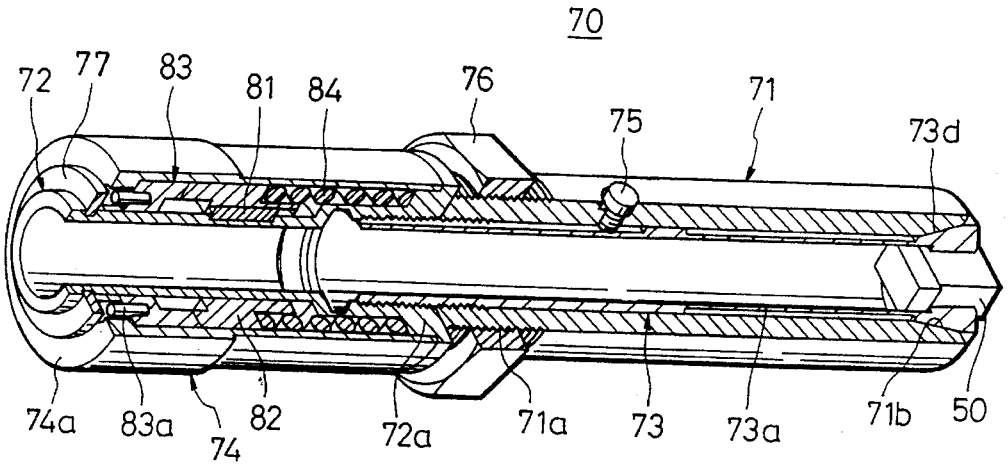
FIG. 17 is a perspective view, partially in section, showing the holding fixture of FIG. 16.
Figure 18:
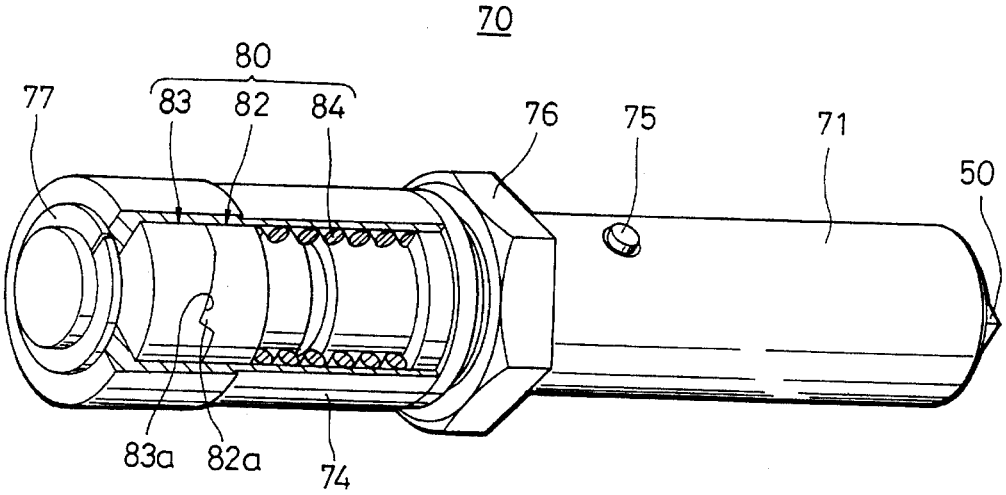
FIG. 18 is a perspective view of the holding fixture of FIG. 16 including a cutaway view of an outer cylinder thereof.

Referring now to FIGS. 16 to 18, there will be described another embodiment of the collet chuck whose force to hold the optical connector can be kept at a predetermined value or below.

As shown in FIG. 16, a collet chuck 70 is provided with a lower cylinder 71 and an inner cylinder 72 arranged adjacent to each other, a chuck 73, an outer cylinder 74 located outside the inner cylinder 72, and a holding force transmission mechanism (hereinafter referred to as "transmission mechanism") 80 interposed between the inner and outer cylinders 72 and 74.

The lower cylinder 71 is a hollow cylinder which is united with the inner cylinder 72 by means of the chuck 73. A fine-pitch thread portion 71*a* is formed on the outer periphery of the upper part of the cylinder 71, and a downwardly spreading taper portion 71*b* is formed on the inner surface of the lower part. A setscrew 75 is attached to the lower cylinder 71 in the vicinity of the thread portion 71*a* in a manner such that its tip end projects inward. An adjusting nut 76 (mentioned later) is screwed on the thread portion 71*a*.

The inner cylinder 72 is a hollow cylinder which has an outside diameter larger than that of the lower cylinder 71 and an inside diameter substantially equal to that of the chuck 73. A retaining portion 72*a* is formed on the lower-cylinder side of the inner cylinder 72, and a key groove 72*b* substantially in the middle of the cylinder 72. Moreover, a female thread portion 72*c* is formed on the inside of the lower-cylinder side of the inner cylinder 72.

The chuck 73, which is inserted in the lower cylinder 71 with their ends projecting on each side, includes four holding claws 73*a*, a male thread portion 73*b* formed on the outer periphery of its top portion, and a retaining groove 73*c* formed on its upper portion so as to extend in the longitudinal direction. The claws 73*a* are formed by dividing the lower near-half portion of a hollow cylinder in four. Each claw 73*a* has a taper surface 73*d* on the outside of its distal end, corresponding in shape to the taper portion 71*b* of the lower cylinder 71.

The outer cylinder 74, which covers the transmission mechanism 80 in conjunction with the inner cylinder 72, is a cup-shaped cover having a flange 74*a* on one side and open on the other side. The flange 74*a* is formed with two pin holes 74*b*.

The adjusting nut 76, like the adjusting nut 64, is used properly to adjust the depth of polishing of the end face of the optical connector 50. The nut 76 is previously screwed on the thread portion 71*a* of the lower cylinder 71, and can be fixed in a desired position on the thread portion 71*a* by means of a fixing screw 76*a*.

The transmission mechanism 80 transmits the rotatory force of the outer cylinder 74 to the inner cylinder 72. When the rotatory force of the outer cylinder 74 in the direction to engage the chuck 73 exceeds a predetermined value, the mechanism 80 interrupts further transmission of the rotatory force, thereby preventing an excessive holding force from the chuck 73 from acting on the optical connector 50. As shown in FIG. 16, the transmission mechanism 80 includes a key 81 located in the key groove 72*b* of the inner cylinder 72, a slider 82 provided outside the key 81, a cylinder 83 cooperating with the slider 82, and a push spring 84 interposed between the slider 82 and the retaining portion 72*a* of the inner cylinder 72.

The force of the chuck 73 to hold the optical connector 50 depends on the urging force of the push spring 84. In other words, the predetermined connector holding force of the chuck 73 can be changed by suitably changing the urging force of the spring 84.

As shown in FIG. 18, the slider 82 has two slopes, easy and steep, and a projection 82*a* projecting toward the cylinder 83. On the other hand, the cylinder 83 is formed with a recess 83*a*, which mates with the projection 82*a*, and pins 83*b* fitted individually in the pin holes 74*b* of the outer cylinder 74.

The collet chuck 70 of the present embodiment thus constructed is assembled in the following manner.

First, the optical connector 50 is inserted into the chuck 73 and held by means of the four holding claws 73*a*.

Then, the chuck 73, holding the optical connector 50 therein, is inserted into the lower part of the lower cylinder 71 with the male thread portion 73*b* forward in a manner such that the tip end of the setscrew 75 is situated corresponding to the retaining groove 73*c*, and the male thread portion 73*b* is caused to project from the top of the lower cylinder 71.

Subsequently, the inner cylinder 72 is rotated in this state as the female thread portion 72*c* is screwed on the male thread portion 73*b* of the chuck 73. When the female thread portion 72*c* of the inner cylinder 72 engages the male thread portion 73*b* of the chuck 73, the lower cylinder 71 and the chuck 73 integrally move in association with the inner cylinder 72. As the engagement between the female and male thread portions 72*c* and 73*b* becomes deeper, the chuck 73 moves to the left of FIG. 16.

Thereafter, the key 81 and the push spring 84 are arranged in the key groove 72*b* of the inner cylinder 72 and outside the cylinder 72, respectively.

The collet chuck 70 is assembled by fitting the slider 82 and the cylinder 83 on the inner cylinder 72, putting the outer cylinder 74 on the resulting structure with the pins 83*b* in the pin holes 74*b*, and fixing the outer cylinder 74 to the inner cylinder 72 by means of a retaining ring 77.

When the outer cylinder 74 of the collet chuck 70 thus constructed is rotated in the clockwise direction by holding the lower cylinder 71, the rotatory force of the outer cylinder 74 is transmitted to the inner cylinder 72 through the transmission mechanism 80. As the inner cylinder 72 is rotated thereby in the clockwise direction so that the female thread portion 72*c* engages the male thread portion 73*b* deeper and deeper, the chuck 73 is gradually pulled up to the side of the inner cylinder 72.

When the taper surface 73*d* of each holding claw 73*a* of the chuck 73 abuts against the taper portion 71*b*, the four holding claws 73*a* are guided to be contracted by the taper portion 71*b*. Thus, the optical connector 50 is securely held by means of the four holding claws 73*a*.

If the outer cylinder 74 is rotated so far in the clockwise direction that its rotatory force exceeds the predetermined value, the recess 83*a* of the cylinder 83 in the transmission mechanism 80 slides along the projection 82*a*, and the slider 82 slightly moves to the right against the urging force of the push spring 84.

As a result, the cylinder 83 slips on the slider 82, so that the transmission of the rotatory force of the outer cylinder 74 exceeding the predetermined value to the collet chuck 70 is interrupted, so that the force of the chuck 73 to hold the optical connector 50 can always be kept at the predetermined value or below.

In removing the held optical connector 50 from the collet chuck 70, on the other hand, the outer cylinder 74 is rotated in the counterclockwise direction. Thereupon, the rotatory force is transmitted from the cylinder 83 to the slider 82 through the respective steep slopes of the projection 82*a* and the recess 83*a*. Thus, the rotatory force of the outer cylinder 74 is transmitted to the inner cylinder 72 via the transmission mechanism 80, so that the inner cylinder 72 rotates in the counterclockwise direction. As the female thread portion 72*c* of the inner cylinder 72 is gradually disengaged from the male thread portion 73*b*, the chuck 73 is pushed out from the lower cylinder 71, whereupon the optical connector 50 is released from the hold.

Thus, in the collet chuck 70, the force of the chuck 73 to hold the optical connector 50 is kept at the predetermined value or below. When the optical connector 50 is held by means of the collet chuck 70, therefore, it is not subjected to any excessive holding force, and hence cannot be distorted. In consequence, the use of the collet chuck 70 facilitates higher-accuracy end machining of the optical connector 50.

What is claimed is:

1. An optical connector end machining apparatus for collectively machining respective end faces of a plurality of optical connectors, comprising:

a removing section for removing an adhesive agent swollen on the end faces of the optical connectors;

a polishing section located adjacent to the removing section and adapted to grind and polish the end faces of the optical connectors cleared of the adhesive agent; and a switching section including a holding member for holding the optical connectors and adapted collectively to shift the optical connectors held by means of the holding member to the removing section or the polishing section, the holding member releasably holding the optical connectors in a manner such that the end face of each optical connector projects and causing the respective projecting end faces of the optical connectors to move integrally toward and away from the removing section or the polishing section.

2. An end machining apparatus for an optical connector according to claim 1, wherein said removing section includes a removing member adapted to rotate around a rotating shaft rotated by means of first rotating means, thereby removing the adhesive agent swollen on the end faces of the optical connectors held by means of the holding member.

3. An end machining apparatus for an optical connector according to claim 2, wherein said removing member includes a grinding material arranged in the circumferential direction for removing the adhesive agent, the grinding material being narrower than the end face of each optical connector and wider than a deposit area of the adhesive agent.

4. An end machining apparatus for an optical connector according to claim 1, wherein said polishing section includes a polishing member adapted to revolve both on the own axis thereof and around an input shaft through the medium of a gear mechanism, thereby grinding and polishing the end faces of the optical connectors, the input shaft being rotated by means of second rotating means.

5. An end machining apparatus for an optical connector according to claim 1, wherein said holding member is provided with a plurality of fitting holes in which holding fixtures holding the optical connectors are fitted individually, the fitting holes being arranged at predetermined intervals in the circumferential direction.

6. A holding fixture for holding an optical connector, comprising:

first and second cylindrical bodies arranged adjacent to each other; and a chuck inserted in the first cylindrical body with both ends thereof projecting, one end side of the chuck being removably screwed to the second cylindrical body and the other end side holding the optical connector, the force of the chuck to hold the optical connector being adjustable.

7. A holding fixture according to claim 6, further comprising adjusting means for adjusting the depth of polishing of an end face of each held optical connector.

8. A holding fixture according to claim 7, wherein said adjusting means comprises a fine-pitch adjusting nut screwed to the outer periphery of the first cylindrical body adjacent to the second cylindrical body.

9. A holding fixture according to claim 6, further comprising a third cylindrical body located outside the second cylindrical body, and a holding force transmission mechanism located between the second and third cylindrical bodies, and adapted to transmit a rotatory force of the third cylindrical body to the second cylindrical body and to interrupt further transmission of the rotatory force in a predetermined direction when a predetermined value is exceeded by the rotatory force.

10. A holding fixture according to claim 9, wherein said holding force transmission mechanism includes a fourth cylindrical body located between the second and third cylindrical bodies and adapted to rotate in association with the third cylindrical body, a sliding member in engagement with the fourth cylindrical body, at a projecting portion thereof formed on the fourth cylindrical body side, and slidable in the axial direction of the second cylindrical body, and a pressure member for pressing the sliding member toward the fourth cylindrical body.

11. A holding fixture according to claim 10, further comprising adjusting means for adjusting the depth of polishing of a end face of each held optical connector.

12. A holding fixture according to claim 11, wherein said adjusting means comprises a fine-pitch adjusting nut screwed to the outer periphery of the first cylindrical body adjacent to the second cylindrical body.

* * * * *